US006406377B1

(12) United States Patent
Demko

(10) Patent No.: US 6,406,377 B1
(45) Date of Patent: Jun. 18, 2002

(54) INFLATABLE POOL AND SLIDE

(76) Inventor: Jacqueline P. Demko, 70 Coleman Rd., Manchester, CT (US) 06040

( * ) Notice: Subject to any disclaimer, the term of this patent is extended or adjusted under 35 U.S.C. 154(b) by 0 days.

(21) Appl. No.: 09/712,984

(22) Filed: Nov. 16, 2000

(51) Int. Cl.[7] ..... A63G 21/18
(52) U.S. Cl. ..... 472/117; 472/116; 472/128
(58) Field of Search ..... 472/116, 112, 472/128, 134, 136, 137; 4/488, 494

(56) References Cited

U.S. PATENT DOCUMENTS

| | | | | |
|---|---|---|---|---|
| 4,805,898 A | | 2/1989 | Jacober et al. | |
| D308,563 S | | 6/1990 | Knight | |
| RE34,042 E | | 8/1992 | Merino | |
| 5,154,671 A | | 10/1992 | Smollar et al. | |
| 5,507,696 A | * | 4/1996 | Smollar et al. | 472/117 |
| 5,551,922 A | | 9/1996 | Katz et al. | |
| 6,062,983 A | | 5/2000 | Butsook | |
| 6,146,282 A | * | 11/2000 | McCready et al. | 472/117 |

FOREIGN PATENT DOCUMENTS

| | | |
|---|---|---|
| GB | 1 403 504 | 8/1975 |
| GB | 2 041 227 A | 9/1980 |
| GB | 2 110 944 A | 6/1983 |

* cited by examiner

*Primary Examiner*—Kien T. Nguyen
(74) *Attorney, Agent, or Firm*—Richard C. Litman

(57) ABSTRACT

An inflatable pool and slide apparatus for modifying an existing conventional slide comprising a plastic cover with straps to bind the top end to a slide platform, a slide portion with water supplied by a pair of apertured pipes, a recirculating water supply, a landing cushion, and a horseshoe shaped collecting pool.

5 Claims, 3 Drawing Sheets

INFLATABLE POOL AND SLIDE

BACKGROUND OF THE INVENTION

1. Field of the Invention

The present invention relates generally to backyard playground equipment and, more specifically, to an inflatable pool positioned at the base of a conventional slide with a plastic runner extending up the slide with water jets.

2. Description of the Related Art

The relevant art of interest describes various water slides, but none discloses the present invention. There is a need to provide an economical and readily mountable water slide and pool combination to enhance an existing conventional backyard slide.

The related art will be discussed in the order of perceived relevance to the present invention.

U.S. Pat. No. 4,805,898 issued on Feb. 21, 1989, to Jeffrey M. Jacober et al. describes a recreational slide system comprising an angularly upstanding slide having steps and provided with a web-like flexible slide having attached thereto a buoyant landing pad which extends into a soft-walled non-inflatable pool of water. The pool water is recycled back to the load bearing sides of the slide to lubricate the slide. The slide system is distinguishable for being an integrated system requiring the recycled water to enter the load bearing sides of the slide.

U.S. Pat. No. 6,062,983 issued on May 16, 2000, to Peter Butsook describes a horizontally positioned combination water slide and pool system comprising a sliding sheet having peripheral water conduits connected to an elevation ramp which leads into a circular pool having an arcuate raised end wall dispersing a shower of water propelled by pressurized air. The slide and pool system is distinguishable for its horizontal layout and fully integrated system with a shower capability.

U.S. Design Pat. No. 308,563 issued on Jun. 12, 1990, to Tim. S. Knight describes a horizontally positioned water slide having V-shaped ridges on its sliding surface and a water hose located on one raised edge of the slide presumably perforated to distribute water on the slide surface. The water slide is distinguishable for its horizontal position and lack of a pool.

U.S. Reissue Pat. No. 34,042 issued on Aug. 25, 1992, to Dennis Merino describes a horizontally positioned wave surfing simulation apparatus comprising an elongated water slide having a plurality of water jet openings along one side and transversely positioned inflatable air chambers to create an undulating effect. The apparatus is distinguishable for its required transversely located inflatable air chambers in the water slide.

U.S. Pat. No. 5,551,922 issued on Sep. 3, 1996, to Harvey Katz et al. describes a horizontal toy water slide and pool system anchored to a level ground by stakes. A water spray head distributes a continuous supply onto the slide portion. The pool portion is formed of several shallow pools connected by ridges in a serpentine fashion. The toy system is distinguishable for its horizontal layout and required serpentine arranged shallow pools.

U.S. Pat. No. 5,154,671 issued on Oct. 13, 1992, to Marvin Smollar et al. describes a backyard type, horizontally and sequentially arranged water slide, water curtain and pool system. The plastic apparatus provides a hoop supplying a water spray fore and aft through which the participants pass through to enter the pool area. The system is distinguishable for its integrated slide, water curtain and pool structure, and which system is horizontally positioned.

U.K. Patent Application No. 1 403 504 published on Aug. 20, 1975, for John M. Fisher describes an inflatable escape slide for evacuating personnel from offshore oil production platforms having a lateral guy system. The escape slide is distinguishable for its required guy system.

U.K. Patent Application No. 2 041 227 A published on Sep. 10, 1980, for Frank L. Canning describes a flexible marine ply slide made of sections which are attached by battens to a polythene covered ground surface. The slide is covered with a rubber layer with an adhesive. The slide is distinguishable for its use of battens and the lack of a continuous flow of water.

U.K. Patent Application No. 2 110 944 published on Jun. 29, 1923, for William S. Sillitoe describes a rectangular recreational slide made of polyethylene which is horizontally installed by wire loop stakes on the ground beneath a chute to provide a water containing circular kerb. The pool containing slide is distinguishable for its placement only on the ground.

None of the above inventions and patents, taken either singularly or in combination, is seen to describe the instant invention as claimed. Thus, an inflatable pool and slide solving the aforementioned problems of economic cost and adaptability to convert an existing slide is desired.

SUMMARY OF THE INVENTION

The present invention is directed to an economic water slide and pool system designed to convert a conventional backyard slide to an aquatic mode. The conversion kit can be readily installed and removed. The slide portion is elongated and has a strap element proximate the end to bind on a platform of a conventional slide. The slide portion contains a pair of water conduits with pinholes positioned at the junctions of the vertical sides and the base of the slide portion. An air inflated landing cushion is integrated at the bottom end of the slide where a horseshoe shaped pool of water is attached. A water hose feeds the water to the slide conduits. The pool has an air inflatable wall and bottom.

Accordingly, it is a principal object of the invention to provide an economic water slide and pool system designed to convert a conventional backyard slide to an aquatic mode.

It is another object of the invention to provide a conversion kit which can be readily installed and removed.

It is a further object of the invention to provide a slide portion containing a pair of water conduits with pinholes positioned at the junctions of the vertical sides and the base of the slide portion.

Still another object of the invention is to provide an air inflated landing cushion integrated at the bottom end of the slide where a horseshoe shaped pool of water is attached.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
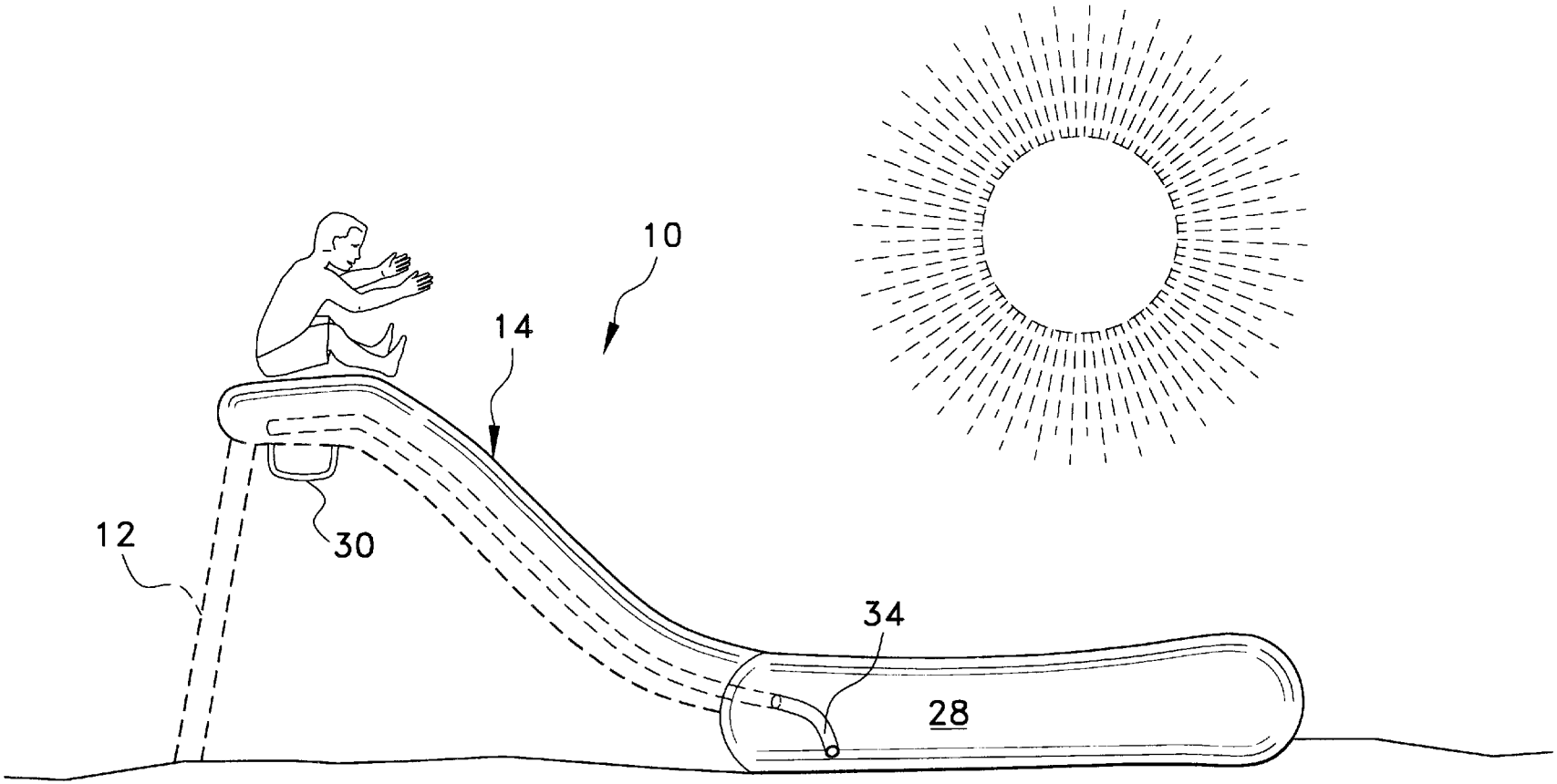
FIG. 1 is an environmental, side elevational view of an inflatable pool and slide attached to a conventional slide according to the present invention.
Figure 2:
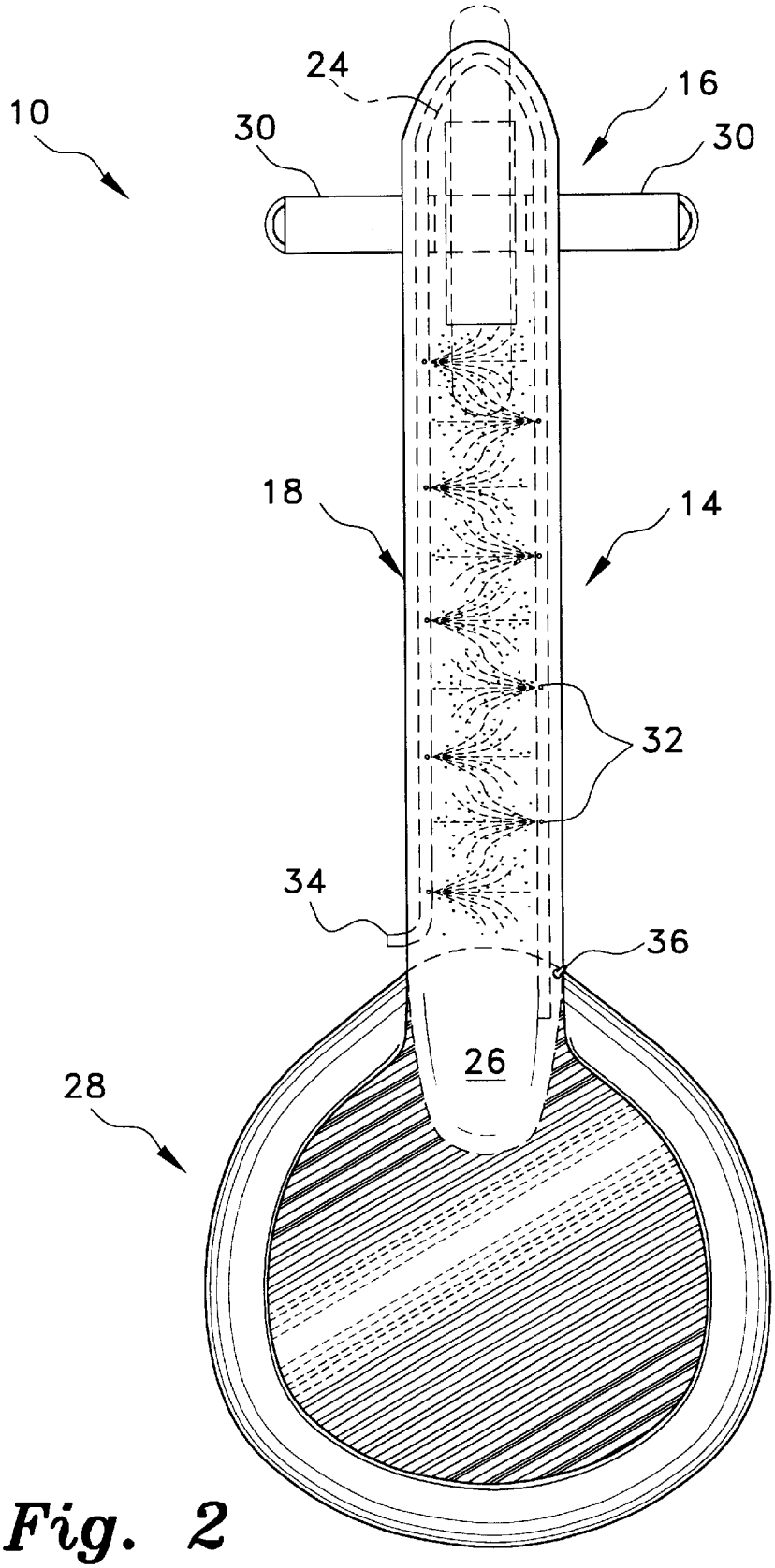
FIG. 2 is a top plan view of the present invention.
Figure 3:
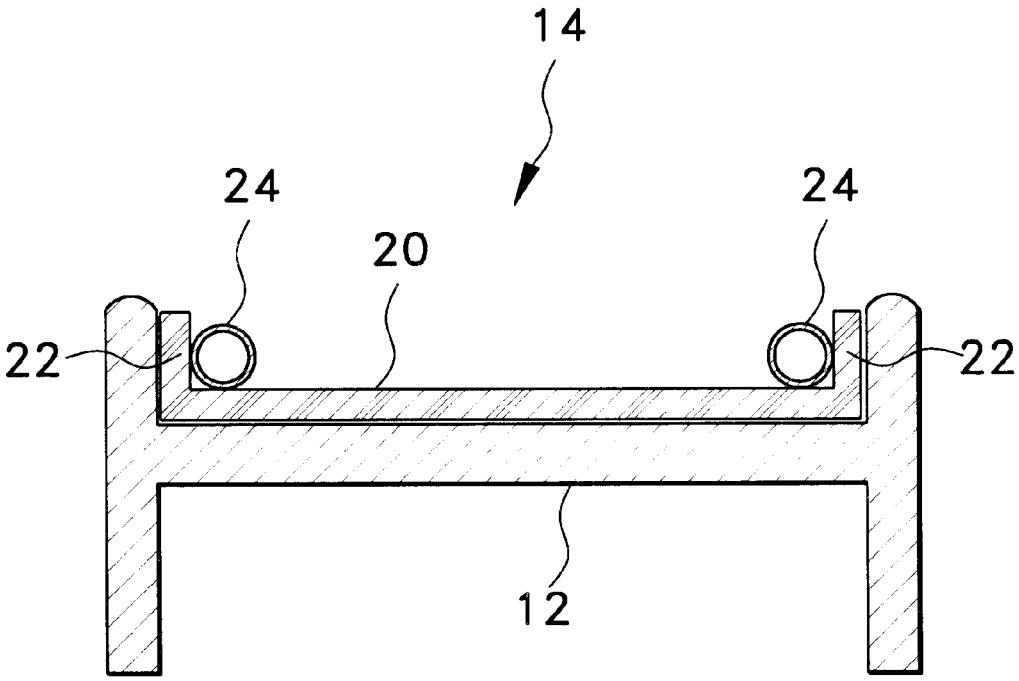
FIG. 3 is a cross-sectional view of the plastic slide cover on a conventional slide.

The present invention in FIGS. 1 to 3 is directed to an inflatable pool and water slide apparatus 10 for an existing inclined slide 12 (in shadow in FIG. 1) comprising an elongated flexible slide portion 14 having a top portion 16, a bottom portion 18, a base portion 20, and two side portions 22 adapted to cover the internal slide portion of an existing inclined slide 12.

A pair of water distributing pipes 24 are positioned in the elongated slide portion 14 along the junctions of the base portion 20 and the side portions 22 in a continuous U-shaped pattern. An inflatable landing pad portion 26 is made integral with the elongated slide portion 14. An inflatable pool portion 28 is integral with the elongated slide portion 14 and the landing pad portion 26. Nylon straps and buckles 30 are provided at the sides of the top portion 16 of the apparatus 10 to attach to the existing inclined slide 12. The straps and buckles 30 can alternatively be attached from front to rear of the top portion 16 (shown in shadow) depending on the direction of the platform decking configuration.

The water distributing pipes 24 have perforations 32 for spraying water inwardly to lubricate the slide portion 14. A water inlet 34 is provided at the bottom portion of the slide portion 14. The collecting water in the pool portion 28 can be recycled by a pump (not shown) to the water inlet 34. An air valve 36 is provided to inflate the landing pad portion 26 and the pool portion 28.

The apparatus 10 can be made of durable plastic or rubberized plastic material except for the nylon straps and buckles 30. The pipes 24 can be plastic or metal.

Thus, it has been shown how a conventional slide can be converted economically to an inclined water slide and pool system.

It is to be understood that the present invention is not limited to the embodiment described above, but encompasses any and all embodiments within the scope of the following claims.

I claim:

1. An inflatable pool and water slide apparatus for an existing inclined slide, comprising:

an elongated flexibe slide portion having a top portion, a bottom portion, a base portion, and two side portions adapted to cover the intermal side portion of an existing side;

a pair of water distributing pipes positioned in the elongated slide portion along the junctions of the base portion and the side portions in a continuous U-shaped pattern;

a landing pad portion as an inflatable cushion integral with. the elongated slide portion; and an inflatable pool portion integral with the elongated slide portion and the landing pad portion;

whereby a conventional slide can, be converted to an inclined water slide and pool system.

2. The inflatable pool and water slide apparatus according to claim 1, wherein the pair of water distributing pipes are perforated to produce a spray which lubricates the slide portion.

3. The inflatable pool and water slide apparatus according to claim 1, wherein the top portion of the slide portion has buckled nylon straps for attachment to a platform of the existing slide.

4. The inflatable pool and water slide apparatus according to claim 1, wherein the apparatus is made essentially of plastic.

5. The inflatable pool and water slide apparatus according to claim 1, wherein the apparatus is made essentially of rubberized material.

* * * * *